US011814231B2

(12) United States Patent
Shimono

(10) Patent No.: US 11,814,231 B2
(45) **Date of Patent: *Nov. 14, 2023**

(54) STEAM-RELEASING POUCH

(71) Applicant: TOPPAN PRINTING CO., LTD., Tokyo (JP)

(72) Inventor: Takahiro Shimono, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/412,020

(22) Filed: Aug. 25, 2021

(65) Prior Publication Data

US 2021/0380322 A1 Dec. 9, 2021

Related U.S. Application Data

(63) Continuation of application No. 16/598,993, filed on Oct. 10, 2019, now Pat. No. 11,124,344, which is a (Continued)

(30) Foreign Application Priority Data

Apr. 12, 2017 (JP) ..... 2017-079042

(51) Int. Cl.
*B65D 77/22* (2006.01)
*B65D 81/34* (2006.01)

(52) U.S. Cl.
CPC ..... *B65D 77/225* (2013.01); *B65D 81/3461* (2013.01)

(58) Field of Classification Search
CPC ... B65D 77/225; B65D 81/3461; B65D 33/01
(Continued)

(56) References Cited

U.S. PATENT DOCUMENTS 6,121,597 A 9/2000 Igota et al.
6,596,355 B1 7/2003 Mita et al.
(Continued)

FOREIGN PATENT DOCUMENTS

CN 1829641 A 9/2006
JP 2001-146276 A 5/2001
(Continued)

OTHER PUBLICATIONS

Machine translation of JP-2001270569-A.*
(Continued)

*Primary Examiner* — Jes F Pascua
(74) *Attorney, Agent, or Firm* — SQUIRE PATTON BOGGS (US) LLP

(57) ABSTRACT

A steam-releasing pouch includes two laminated sheets forming an accommodation compartment that accommodates a content, a sealing portion that seals the two sheets to form an opening that opens part of the accommodation compartment, and a steam-releasing sealing portion formed in the sealing portion to open as pressure of the accommodation compartment increases in a state in which the opening is sealed. The steam-releasing sealing portion includes a first sealant layer having at least a first base layer that faces the accommodation compartment and a second base layer laminated with the first base layer and a second sealant layer having at least a third base layer that faces the accommodation compartment and a fourth base layer laminated with the third base layer. The first base layer and the third base layer are joined together.

16 Claims, 6 Drawing Sheets

Related U.S. Application Data continuation of application No. PCT/JP2018/015280, filed on Apr. 11, 2018.

(58) Field of Classification Search

USPC ..... 383/100–103

See application file for complete search history.

(56) References Cited

U.S. PATENT DOCUMENTS

| | | | | |
|---|---|---|---|---|
| 11,124,344 | B2 * | 9/2021 | Shimono | B65D 81/3461 |
| 2003/0123758 | A1 | 7/2003 | Mita et al. | |
| 2005/0255200 | A1 | 11/2005 | Takahagi et al. | |
| 2019/0047772 | A1 | 2/2019 | Oishi et al. | |

FOREIGN PATENT DOCUMENTS

| | | | | |
|---|---|---|---|---|
| JP | 2001270569 | A | * | 10/2001 |
| JP | 2002-053184 | A | | 2/2002 |
| JP | 2005-088971 | A | | 4/2005 |
| JP | 2006160308 | A | * | 6/2006 |
| JP | 2007204129 | A | * | 8/2007 |
| JP | 2007-302321 | A | | 11/2007 |
| JP | 2010036969 | A | * | 2/2010 |
| JP | 2012218782 | A | * | 11/2012 |
| JP | 2013-032168 | A | | 2/2013 |
| JP | 2013-043669 | A | | 3/2013 |
| JP | 2013-086871 | A | | 5/2013 |
| JP | 2013091513 | A | * | 5/2013 |
| JP | 2014-114062 | A | | 6/2014 |
| JP | 2015-120550 | A | | 7/2015 |
| JP | 2015-137127 | A | | 7/2015 |
| JP | 2015-168151 | A | | 9/2015 |
| JP | 2017-024733 | A | | 2/2017 |
| TW | 542806 | B | | 7/2003 |

OTHER PUBLICATIONS

Machine translation of JP-2010036969-A.*

Machine translation of JP-2013091513-A.*

Machine translation JP-2012218782-A.*

Chinese Office Action for Chinese Patent Application No. 201880024392.1, 13 pages, with translation, dated Apr. 2, 2021.

International Search Report dated Jun. 5, 2018, in International Patent Application No. PCT/JP2018/015280, 1 page.

Supplemental European Search Report for European Patent Application No. EP 18784146.5, 9 pages, dated Nov. 30, 2020.

Communication Pursuant to Article 94(3) EPC dated Nov. 3, 2022 for European Patent Application No. 18784146.5, 6 pages.

* cited by examiner

Fig.10

| | Comparative Example | Example1 | Example2 | Example3 | Example4 | Example5 | Example6 | Example7 |
|---|---|---|---|---|---|---|---|---|
| Thickness of First Sealant Layer [μm] | 60 | 60 | 60 | 60 | 60 | 60 | 60 | 60 |
| Thickness of First Base Layer [μm] | - | 3 | 5 | 10 | 15 | 20 | 25 | 30 |
| Thickness of Second Base Layer [μm] | - | 57 | 55 | 50 | 45 | 40 | 35 | 30 |
| First Base Layer by Percentage [%] | - | 5 | 8 | 17 | 25 | 33 | 42 | 50 |
| Second Base Layer by Percentage [%] | - | 95 | 92 | 83 | 75 | 67 | 58 | 50 |
| Base Layer Thickness by Percentage [%] | - | 5.2 | 9.1 | 20 | 33 | 50 | 71 | 100 |

Fig.11

| | 1st Time | 2nd Time | 3rd Time | 4th Time | 5th Time | 6th Time | 7th Time | 8th Time | 9th Time | 10th Time |
|---|---|---|---|---|---|---|---|---|---|---|
| Comparative Example | △ | × | △ | △ | △ | △ | △ | △ | × | × |
| Example1 | ○ | △ | ○ | ○ | ○ | △ | ○ | ○ | ○ | ○ |
| Example2 | ○ | ○ | ○ | ○ | ○ | ○ | ○ | ○ | ○ | ○ |
| Example3 | ○ | ○ | ○ | ○ | ○ | ○ | ○ | ○ | ○ | ○ |
| Example4 | ○ | ○ | ○ | ○ | ○ | ○ | ○ | ○ | ○ | ○ |
| Example5 | ○ | ○ | ○ | ○ | ○ | ○ | ○ | ○ | ○ | ○ |
| Example6 | ○ | ○ | ○ | ○ | ○ | ○ | ○ | ○ | ○ | ○ |
| Example7 | ○ | △ | ○ | ○ | △ | ○ | ○ | ○ | ○ | ○ |

STEAM-RELEASING POUCH

CROSS-REFERENCE TO RELATED APPLICATIONS

The present application is a continuation of U.S. patent application Ser. No. 16/598,993, filed Oct. 10, 2019, which is a continuation of International Application No. PCT/JP2018/015280, filed Apr. 11, 2018, which claims the benefit of and priority from Japanese Patent Application No. JP 2017-079042, filed on Apr. 12, 2017. All of the above-mentioned applications are incorporated herein by reference.

BACKGROUND

The present disclosure relates to a steam-releasing pouch.

A known steam-releasing pouch includes a steam-releasing sealing portion to release steam generated from a heated content out of the pouch. In the steam-releasing pouch, when the steam generated from the content increases the pressure of an internal space in the steam-releasing pouch, the steam-releasing sealing portion opens (more specifically, two sheets of the steam-releasing sealing portion are separated from each other) so that a passage is formed in the steam-releasing sealing portion. Thus, the steam in the internal space of the steam-releasing pouch passes through the passage and is discharged out of the steam-releasing pouch. Japanese Laid-Open Patent Publication No. 2014-114062 discloses an example of a conventional steam-releasing pouch. The steam-releasing pouch includes a top sealing portion (6) formed by a sealant layer of a front surface body film (2) and a sealant layer of a rear surface body film (3), which are bonded to each other, as illustrated in Japanese Laid-Open Patent Publication No. 2014-114062 in FIG. 1 and the like. The top sealing portion (6) includes a steam-venting sealing portion (15), which is formed to bulge toward the accommodation compartment of the steam-releasing pouch. The steam-venting sealing portion (15) is an example of the steam-releasing sealing portion.

With the known steam-releasing pouch, the steam-releasing sealing portion may not open appropriately when the pressure in the internal space of the steam-releasing pouch increases. This may decrease the amount of steam discharged out of the steam-releasing pouch. An example of a state in which the steam-releasing sealing portion does not open appropriately is a state in which the pressure increases and separates part of the sheets of the steam-releasing sealing portion, thereby forming a passage that allows the passage of steam, but does not fully separate the sheets in a portion where the passage is formed. It is understood that this results from the relationship between the direction in which the separation occurs in the steam-releasing sealing portion and the machine direction of resin in the sheets of the steam-releasing pouch. If the separation in the steam-releasing sealing portion occurs in a direction orthogonal to or substantially orthogonal to the machine direction of resin, the machine direction of resin will act on the steam-releasing sealing portion against the pressure of the accommodation compartment. This will hinder separation in the steam-releasing sealing portion and form a passage where the sheets are separated and a part where sufficient separation does not occur.

SUMMARY (1) A steam-releasing pouch according to one aspect of the present disclosure includes two laminated sheets forming an accommodation compartment that accommodates a content, a sealing portion that seals the two sheets to form an opening that opens part of the accommodation compartment, and a steam-releasing sealing portion formed in the sealing portion to open as pressure of the accommodation compartment increases in a state in which the opening is sealed. The steam-releasing sealing portion includes a first sealant layer having at least a first base layer that faces the accommodation compartment and a second base layer laminated with the first base layer and a second sealant layer having at least a third base layer that faces the accommodation compartment and a fourth base layer laminated with the third base layer. The first base layer and the third base layer are joined together.

When the heating of the content increases the pressure of the accommodation compartment, force acts on the first base layer and the third base layer to separate the first base layer and the third base layer from each other at an edge of an interface of the first base layer and the third base layer in the steam-releasing sealing portion. If the direction in which separation advances in the steam-releasing sealing portion is the same as the direction orthogonal to the machine direction of resin or substantially the same as the direction orthogonal to the machine direction of resin, stress concentrates on the edge of the interface of the first base layer and the third base layer and partially tears one or both of the first base layer and the third base layer. If the first base layer, for example, is torn, an edge is formed at the torn part in an interface of the first base layer and the second base layer of the first sealant layer. The edge is exposed to the accommodation compartment, and the pressure in the accommodation compartment acts on the interface of the first base layer and the second base layer and separates the first base layer and the second base layer from each other. The base layers of the sealant layer are joined together at the interface in a separable manner by a relatively weak force. Thus, when a force acts to separate the first base layer and the second base layer, the first base layer and the second base layer are cleanly separated. As the separation of the first base layer and the second base layer further advances, a first separation state or a second separation state will usually be obtained as described below. In the first separation state, the first base layer located toward an outer side of the steam-releasing pouch from the interface of the first base layer and the second base layer before separation is partially torn so that the accommodation compartment is connected with the outside of the steam-releasing pouch. In the second separation state, separation of the first base layer and the second base layer advances until the accommodation compartment is connected with the outside of the steam-releasing pouch. In this manner, with the steam-releasing pouch, if the direction in which separation advances in the steam-releasing sealing portion is the same as the direction orthogonal to the machine direction of resin or substantially the same as the direction orthogonal to the machine direction of resin, the separation advances between the base layers of the first sealant layer and the second sealant layer instead of between the first sealant layer and the second sealant layer. This result in appropriate separation in the steam-releasing sealing portion. Thus, steam will be easily discharged in an appropriate manner.

(2) Preferably, the first base layer and the second base layer have different inner structures, the third base layer and the fourth base layer have different inner structures, and the first base layer and the third abase layer have the same inner structure.

The first base layer and the third base layer, which have the same inner structure, are joined together so that separation will easily advance between the first base layer and the second base layer or between the third base layer and the fourth base layer, which have different inner structures. Thus, the steam-releasing sealing portion will easily open in a more appropriate manner.

(3) The steam-releasing pouch in described (1) or (2), in which, preferably, the first base layer, the second base layer, the third base layer, and the fourth base layer contain block copolymers, the block copolymer has a percentage of weight that differs between the first base layer and the second base layer, and the block copolymer has a percentage of weight that differs between the third base layer and the fourth base layer.

Separation will easily advance between the first base layer and the second base layer, in which the block copolymer has a different percentage of weight, or separation will easily advance between the third base layer and the fourth base layer, in which the block copolymer has a different percentage of weight. Thus, the steam-releasing sealing portion will easily open in a more appropriate manner.

(4) Preferably, the second base layer has a thickness that is less than or equal to 95% of the thickness of the first sealant layer.

The first base layer and the second base layer were observed to be easily separated in an appropriate manner in a test when the thickness of the second base layer was within the above range.

(5) Preferably, the second base layer has a thickness that is less than or equal to 92% of the thickness of the first sealant layer.

The first base layer and the second base layer were observed to be easily separated in a more appropriate manner in a test when the thickness of the second base layer was within the above range.

(6) Preferably, the second base layer has a thickness that is greater than or equal to 50% of the thickness of the first sealant layer.

The first base layer and the second base layer were observed to be easily separated in an appropriate manner in a test when the thickness of the second base layer was within the above range.

(7) Preferably, the second base layer has a thickness that is greater than or equal to 58% of the thickness of the first sealant layer.

The first base layer and the second base layer were observed to be easily separated in a more appropriate manner in a test when the thickness of the second base layer was within the above range.

(8) Preferably, the first base layer has a thickness that is less than or equal to 50% of the thickness of the first sealant layer.

The first base layer and the second base layer were observed to be easily separated in an appropriate manner in a test when the thickness of the first base layer was within the above range.

(9) Preferably, the first base layer has a thickness that is less than or equal to 42% of the thickness of the first sealant layer.

The first base layer and the second base layer were observed to be easily separated in a more appropriate manner in a test when the thickness of the first base layer was within the above range.

(10) Preferably, the first base layer has a thickness that is greater than or equal to 5% of the thickness of the first sealant layer.

The first base layer and the second base layer were observed to be easily separated in an appropriate manner in a test when the thickness of the first base layer was within the above range.

(11) Preferably, the first base layer has a thickness that is greater than or equal to 8% of the thickness of the first sealant layer.

The first base layer and the second base layer were observed to be easily separated in a more appropriate manner in a test when the thickness of the first base layer was within the above range.

(12) Preferably, the first base layer has a thickness that is within a range of 5% to 100% in percentage relative to the thickness of the second base layer.

The first base layer and the second base layer were observed to be easily separated in an appropriate manner in a test when the thickness of the first base layer in percentage relative to the thickness of the second base layer was within the above range.

(13) Preferably, the first base layer has a thickness that is within a range of 9% to 71% in percentage relative to the thickness of the second base layer.

The first base layer and the second base layer were observed to be easily separated in a more appropriate manner in a test when the thickness of the first base layer in percentage relative to the thickness of the second base layer was within the above range.

(14) Preferably, the two sheets includes a pouch body that forms a main part of the accommodation compartment, and a projection configured to pop out of the pouch body, in which the steam-releasing sealing portion is arranged in the projection.

Thus, when the steam-releasing sealing portion is open, a content accommodated in the accommodation compartment is less likely to be leaked out from a separated portion of the steam-releasing sealing portion.

BRIEF DESCRIPTION OF THE DRAWINGS

FIG. 10 is a table showing test conditions of a comparative example and an example.

FIG. 11 is a table showing test results of the comparative example and the example.

DESCRIPTION OF EXEMPLARY EMBODIMENTS

The following embodiment is an example of forms that a steam-releasing pouch according to the present disclosure may take, which is not intended to restrict the form. The steam-releasing pouch according to the present disclosure may take a form different from that described in the embodiment. Examples of such modification may include forms in which part of the configuration of the embodiment is replaced, changed, or removed.

Embodiment

Figure 1:
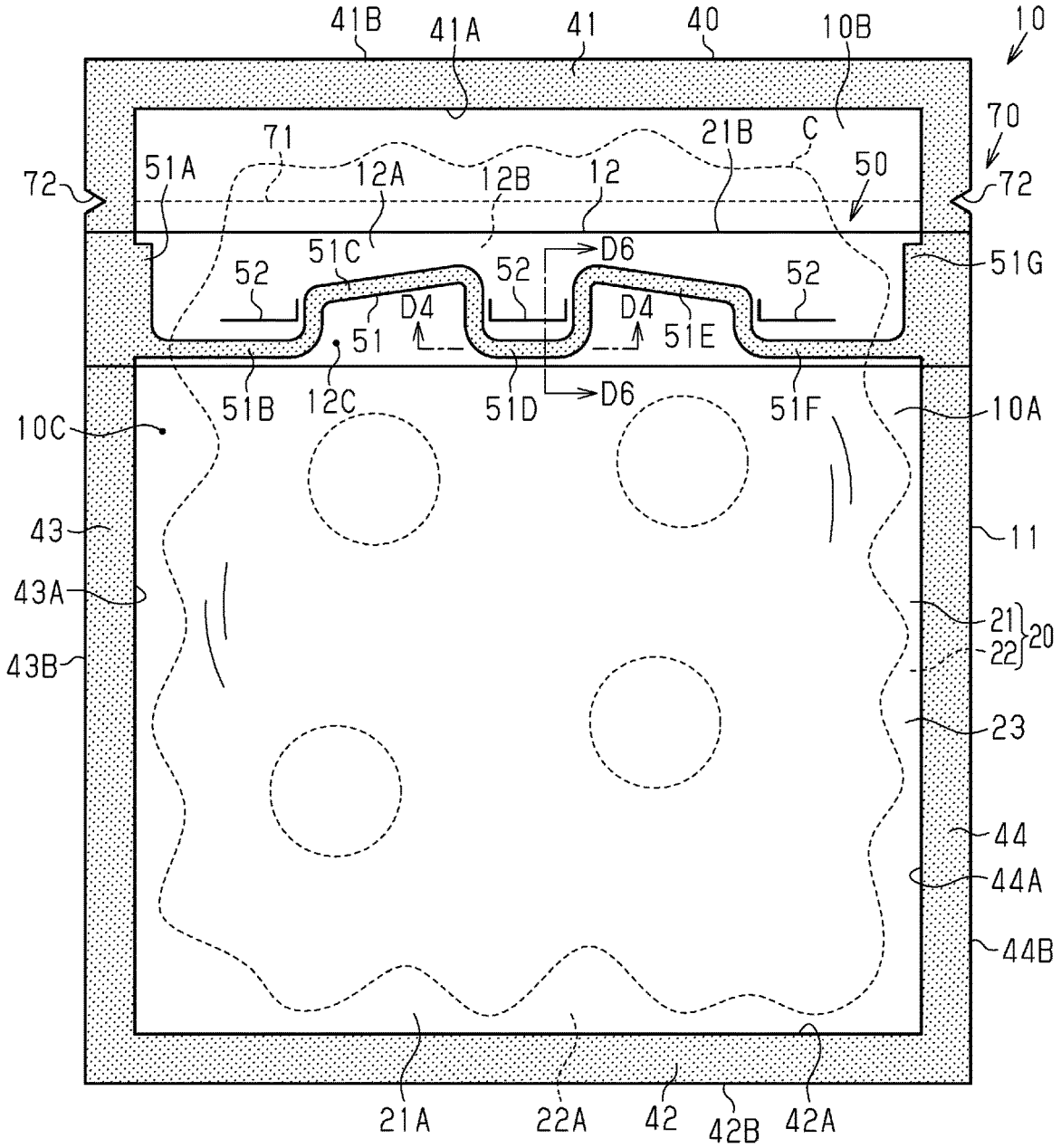
FIG. 1 is a front view of a steam-releasing pouch according to one embodiment of the present disclosure.

FIG. 1 shows an example of a steam-releasing pouch 10 that can accommodate a content C, which is suitable for heating, and discharge steam generated from the content C. The content C is a heated subject that generates steam when heated. One example of the content C is a food product. An example of a food product has fluidity such as stew, soup, or the like. The steam-releasing pouch 10 is configured to store the content C for a long period while maintaining the quality of the content C. The steam-releasing pouch 10 may take any of various types of forms. Examples of the forms that the steam-releasing pouch 10 may take include a flat bag type, a standing type, a gusset type, and a pillar type. The form of the steam-releasing pouch 10 shown in FIG. 1 is of the flat bag type. The right-left direction of the steam-releasing pouch 10 in a front view of the steam-releasing pouch 10 will be referred to as a standard widthwise direction and a direction orthogonal to the standard widthwise direction in FIG. 1 will be referred to as a standard height-wise direction.

The steam-releasing pouch 10 includes sheets 20, a sealing portion 40, a steam-releasing portion 50, an opening 60 (refer to FIG. 3), and a guide portion 70. The shadings in FIG. 1 and the like indicate the sealing portion 40 and a steam-releasing sealing portion 51 of the steam-releasing portion 50. The sheets 20 include a first sheet 21 and a second sheet 22. The first sheet 21 and the second sheet 22 are opposed to each other so that an accommodation compartment 10C that accommodates the content C is defined between the sheets 21, 22. The configuration of the sheets 20 can be selected in any manner. In a first example, the sheets 21, 22 are two sheets, which are separately formed. In a second example, the sheets 21, 22, which are opposed to each other, are formed by bending a single sheet.

The sheets 20 have a layer structure of laminated layers. The layer structure of the sheets 20 can be selected in any manner. In a first example, the sheets 21, 22 have the same layer structure. In a second example, the sheets 21, 22 have different layer structures. FIG. 1 shows the steam-releasing pouch 10 formed by the sheets 20 having the layer structure of the first example.

Figure 2:
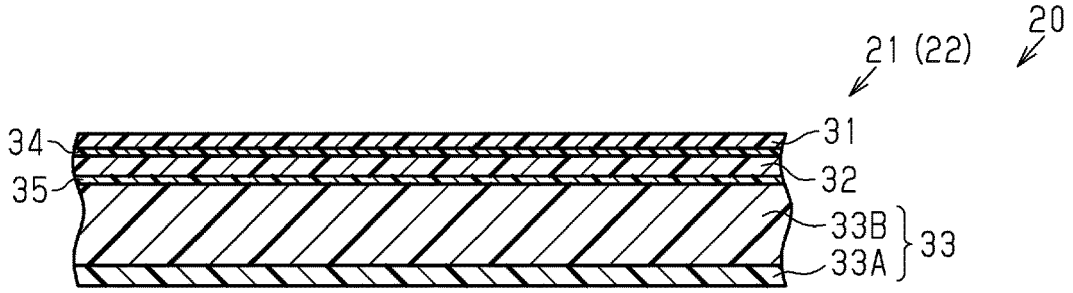
FIG. 2 is a cross-sectional view of the layer structure of a sheet in FIG. 1.

FIG. 2 illustrates the cross-sectional structure of each of the sheets 21, 22 taken along the thickness directions of the sheets 21, 22. The sheets 21, 22 each include an outermost layer 31, an intermediate layer 32, a first sealant layer 33, a first bonding layer 34, and a second bonding layer 35. One example of a method for manufacturing the sheets 21, 22 is dry lamination. The first bonding layer 34 is arranged between the outermost layer 31 and the intermediate layer 32 to bond the outermost layer 31 and the intermediate layer 32. The second bonding layer 35 is arranged between the intermediate layer 32 and the first sealant layer 33 to bond the intermediate layer 32 and the first sealant layer 33. The machine direction of a resin material of the layers 31 to 33 corresponds to the standard widthwise direction of the steam-releasing pouch 10. The transverse direction orthogonal to the machine direction of the resin material corresponds to the standard height-wise direction of the steam-releasing pouch 10.

The outermost layer 31 is mainly superior in gloss, printability, and retort resistance (heat resistance, water resistance). One example of a material of the outermost layer 31 is polyethylene terephthalate. The intermediate layer 32 is mainly superior in retort resistance, moisture resistance, and gas barrier properties. One example of a material of the intermediate layer 32 is nylon. The first sealant layer 33 is superior in retort resistance, heat sealing properties, and impact resistance. The first sealant layer 33 includes a first base layer 33A and a second base layer 33B. An example of the first base layer 33A may employ a sealing layer (B) disclosed in Table 1 and the like in Japanese Laid-Open Patent Publication No. 2015-168151. The second base layer 33B may be, for example, a base layer (A) disclosed in Table 1 and the like in Japanese Laid-Open Patent Publication No. 2015-168151. The first base layer 33A and the second base layer 33B have different inner structures. One example of the inner structure of the layer is a sea-island structure of block copolymers contained in the base layers 33A, 33B and a distribution form of the sea-island structure. The first sealant layer 33 is obtained by bonding the first base layer 33A and the second base layer 33B that have different inner structures so that the first base layer 33A and the second base layer 33B can be easily separated.

One example of a material of the first base layer 33A is block copolymers, homopolymers, mixed resin, and linear low-density polyethylene. The percentage of weight of the block copolymers contained in the first base layer 33A (hereafter "first content by percentage") may be selected in any manner. One example of a preferable upper limit of the first content by percentage is 80%. One example of a further preferable upper limit of the first content by percentage is 73%. One example of a preferable lower limit of the first content by percentage is 50%. One example of a further preferable lower limit of the first content by percentage is 55%. One example of a preferable range of the first content by percentage is 50% to 80%. One example of a further preferable range of the first content by percentage is 55% to 73%. One example of a preferable first content by percentage is 68%.

The percentage of weight of the homopolymers contained in the first base layer 33A (hereafter "second content by percentage") may be selected in any manner. One example of a preferable upper limit of the second content by percentage is 20%. One example of a further preferable upper limit of the second content by percentage is 14%. One example of a preferable lower limit of the second content by percentage is 5%. One example of a further preferable lower limit of the second content by percentage is 10%. One example of a preferable range of the second content by percentage is 5% to 20%. One example of a further preferable range of the second content by percentage is 10% to 14%. One example of a preferable second content by percentage is 12%.

The mixed resin contains random copolymers and polyethylene. The percentage of weight of the mixed resin contained in the first base layer 33A (hereafter "third content by percentage") may be selected in any manner. One example of a preferable upper limit of the third content by percentage is 35%. One example of a further preferable upper limit of the third content by percentage is 29%. One example of a preferable lower limit of the third content by percentage is 15%. One example of a further preferable lower limit of the third content by percentage is 25%. One example of a preferable range of the third content by percentage is 15% to 35%. One example of a further preferable range of the third content by percentage is 25% to 29%. One example of a preferable third content by percentage is 15%. The percentage of weight of the linear low-density polyethylene contained in the first base layer 33A (hereafter "sixth content by percentage") may be selected in any manner. One example of a preferable range of the sixth content by percentage is 0% to 7%.

One example of a material of the second base layer 33B is mixed resin containing block copolymers and linear low-density polyethylene. The percentage of weight of the block copolymers contained in the second base layer 33B (hereafter "fourth content by percentage") may be selected in any manner. One example of a preferable upper limit of the fourth content by percentage is 92%. One example of a further preferable upper limit of the fourth content by percentage is 88%. One example of a preferable lower limit of the fourth content by percentage is 55%. One example of a further preferable lower limit of the fourth content by percentage is 65%. One example of a preferable range of the fourth content by percentage is 55% to 92%. One example of a further preferable range of the fourth content by percentage is 65% to 88%. One example of a preferable fourth content by percentage is 75%.

The percentage of weight of the linear low-density polyethylene contained in the second base layer 33B (hereafter "fifth content by percentage") may be selected in any manner. One example of a preferable upper limit of the fifth content by percentage is 45%. One example of a further preferable upper limit of the fifth content by percentage is 35%. One example of a preferable lower limit of the fifth content by percentage is 8%. One example of a further preferable lower limit of the fifth content by percentage is 12%. One example of a preferable range of the fifth content by percentage is 8% to 45%. One example of a further preferable range of the fifth content by percentage is 12% to 35%. One example of a preferable fifth content by percentage is 25%.

The thickness of the layers 31 to 33 (hereafter "layer thickness T") may be selected in any manner. In the first example, the layers 31 to 33 have the same layer thickness T. In the second example, the outermost layer 31 and the intermediate layer 32 have the same layer thickness T, and the first sealant layer 33 has a layer thickness T, which is greater or less than the thickness of the outermost layer 31 and the intermediate layer 32. In a third example, the layers 31 to 33 have layer different thicknesses T. The layer thickness T is the distance between one surface and the other surface of each of the layers 31 to 33 in a cross section that is orthogonal to the sheets 20 in a flat state.

One preferable example of a maximum value for the layer thicknesses T of the outermost layer 31 and the intermediate layer 32 is 50 μm. One further preferable example of the maximum value for the layer thicknesses T of the outermost layer 31 and the intermediate layer 32 is 25 μm. One preferable example of a minimum value for the layer thicknesses T of the outermost layer 31 and the intermediate layer 32 is 6 μm. One further preferable example of the minimum value for the layer thicknesses T of the outermost layer 31 and the intermediate layer 32 is 12 μm. One example of a preferable layer thickness T of the outermost layer 31 is 12 μm. One example of a preferable layer thickness T of the intermediate layer 32 is 15 μm.

One preferable example of a maximum value for the layer thicknesses T of the first sealant layer 33 is 120 μm. One further preferable example of the maximum value for the layer thicknesses T of the first sealant layer 33 is 80 μm. One preferable example of a minimum value for the layer thicknesses T of the first sealant layer 33 is 50 μm. One further preferable example of the maximum value for the layer thicknesses T of the first sealant layer 33 is 60 μm. One example of a preferable layer thickness T of the first sealant layer 33 is 60 μm.

The percentage of the layer thickness T of the first base layer 33A relative to the layer thickness T of the first sealant layer 33 (hereafter "first base layer by percentage") is preferably determined in accordance with the relationship between how easily the second base layer 33B and the first base layer 33A are separated when the pressure of the accommodation compartment 10C increases and how easily the first base layer 33A is torn when the second base layer 33B and the first base layer 33A are separated. One example of a preferable upper limit of the first base layer by percentage is 50%. One example of a further preferable upper limit of the first base layer by percentage is 42%. One example of a preferable lower limit of the first base layer by percentage is 5%. One example of a further preferable lower limit of the first base layer by percentage is 8%. One example of a preferable range of the first base layer by percentage is 5% to 50%. One example of a further preferable range of the first base layer by percentage is 8% to 42%. One example of a preferable first base layer by percentage is 25%. If the first base layer by percentage is less than or equal to 50%, the first base layer 33A is easily torn upon separation of the second base layer 33B and the first base layer 33A. If the first base layer by percentage is less than or equal to 42%, the first base layer 33A is more easily torn upon separation of the second base layer 33B and the first base layer 33A. If the first base layer by percentage is greater than or equal to 5%, the second base layer 33B and the first base layer 33A are easily separated upon an increase of the pressure of the accommodation compartment 10C. If the first base layer by percentage is greater than or equal to 8%, the second base layer 33B and the first base layer 33A are more easily separated upon an increase of the pressure of the accommodation compartment 10C.

The percentage of the layer thickness T of the second base layer 33B relative to the layer thickness T of the first sealant layer 33 (hereafter "second base layer by percentage") is preferably determined in accordance with the relationship between how easily the second base layer 33B and the first base layer 33A are separated when the pressure of the accommodation compartment 10C increases and how easily the first base layer 33A is torn when the second base layer 33B and the first base layer 33A are separated. One example of a preferable upper limit of the second base layer by percentage is 95%. One example of a further preferable upper limit of the second base layer by percentage is 92%. One example of a preferable lower limit of the second base layer by percentage is 50%. One example of a further preferable lower limit of the second base layer by percentage is 58%. One example of a preferable range of the second base layer by percentage is 50% to 95%. One example of a further preferable range of the second base layer by percentage is 58% to 92%. One example of a preferable second base layer by percentage is 75%. If the second base layer by percentage is less than or equal to 95%, the second base layer 33B and the first base layer 33A are easily separated upon an increase of the pressure of the accommodation compartment 10C. If the second base layer by percentage is less than or equal to 92%, the second base layer 33B and the first base layer 33A are more easily separated upon an increase of the pressure of the accommodation compartment 10C. If the second base layer by percentage is greater than or equal to 50%, the first base layer 33A is easily torn upon separation of the second base layer 33B and the first base layer 33A. If the second base layer by percentage is greater than or equal to 58%, the first base layer 33A is more easily torn upon separation of the second base layer 33B and the first base layer 33A.

The percentage of the layer thickness T of the first base layer 33A relative to the layer thickness T of the second base layer 33B (hereafter "base layer thickness by percentage") is preferably determined in accordance with the relationship between how easily the second base layer 33B and the first base layer 33A are separated when the pressure of the accommodation compartment 10C increases and how easily the first base layer 33A is torn when the second base layer 33B and the first base layer 33A are separated. One example of a preferable upper limit of the base layer thickness by percentage is 100%. One example of a further preferable upper limit of the base layer thickness by percentage is 71%. One example of a preferable lower limit of the base layer thickness by percentage is 5%. One example of a further preferable lower limit of the base layer thickness by percentage is 9%. One example of a preferable range of the base layer thickness by percentage is 5% to 100%. One example of a further preferable range of the base layer thickness by percentage is 9% to 71%. One example of a preferable base layer thickness by percentage is 33%. If the base layer thickness by percentage is less than or equal to 100%, the first base layer 33A is easily torn upon separation of the second base layer 33B and the first base layer 33A. If the base layer thickness by percentage is less than or equal to 71%, the first base layer 33A is more easily torn upon separation of the second base layer 33B and the first base layer 33A. If the base layer thickness by percentage is greater than or equal to 5%, the second base layer 33B and the first base layer 33A are easily separated upon an increase of the pressure of the accommodation compartment 10C. If the base layer thickness by percentage is greater than or equal to 8%, the second base layer 33B and the first base layer 33A are more easily separated upon an increase of the pressure of the accommodation compartment 10C.

The sealing portion 40 joins the sheets 21, 22 together so that the first sheet 21 and the second sheet 22 are not separated. In one example, the sealing portion 40 joins the first base layer 33A of the first sheet 21 to the first base layer of the second sheet 22 (not shown). One example of a method for forming the sealing portion 40 is heat sealing. The steam-releasing pouch 10 in a front view may have any shape. In the example shown in FIG. 1, the steam-releasing pouch 10 is a rectangle. The sheets 20 can be divided into the sealing portion 40 and a portion (hereafter "inner portion 23") surrounded by the sealing portion 40. The accommodation compartment 10C, which is a space defined by the inner portion 23 of the first sheet 21 and the inner portion 23 of the second sheet 22, is closed by the sealing portion 40 so as not to be connected with the outside of the steam-releasing pouch 10.

The sealing portion 40 includes an upper sealing portion 41, a lower sealing portion 42, a first side sealing portion 43, and a second side sealing portion 44. The upper sealing portion 41 is arranged on the upper side of the inner portion 23 in the standard height-wise direction. The lower sealing portion 42 closes the opening 60 (refer to FIG. 3). The lower sealing portion 42 is arranged on the lower side of the inner portion 23 in the standard height-wise direction. The first side sealing portion 43 is arranged on the right side or the left side of the inner portion 23 in the standard widthwise direction. The second side sealing portion 44 is arranged on the left side or the right side of the inner portion 23 in the standard widthwise direction.

The inner shape of the inner portion 23 is determined by an inner edge 41A of the upper sealing portion 41 located toward the inner portion 23, an inner edge 42A of the lower sealing portion 42 located toward the inner portion 23, an inner edge 43A of the first side sealing portion 43 located toward the inner portion 23, and an inner edge 44A of the second side sealing portion 44 located toward the inner portion 23. The outer shape of the steam-releasing pouch 10 is determined by an outer edge 41B of the upper sealing portion 41 located at the opposite side of the inner edge 41A, an outer edge 42B of the lower sealing portion 42 located at the opposite side of the inner edge 42A, an outer edge 43B of the first side sealing portion 43 located at the opposite side of the inner edge 43A, and an outer edge 44B of the second side sealing portion 44 located at the opposite side of the inner edge 44A.

The sealing portions 41 to 44 may each have any width. The widths of the sealing portions 41 to 44 are determined by the lengths between the inner edges 41A to 44A and the outer edges 41B to 44B on normals of center lines of the sealing portions 41 to 44. The center lines of the sealing portions 41 to 44 are imaginary line segments, which extend between the inner edges 41A to 44A and the outer edges 41B to 44B. If the width of the sealing portions 41 to 44 differs between parts, the maximum width, for example, or an average width of several parts in each of the sealing portions 41 to 44 represents the width of the sealing portion.

Figure 4:
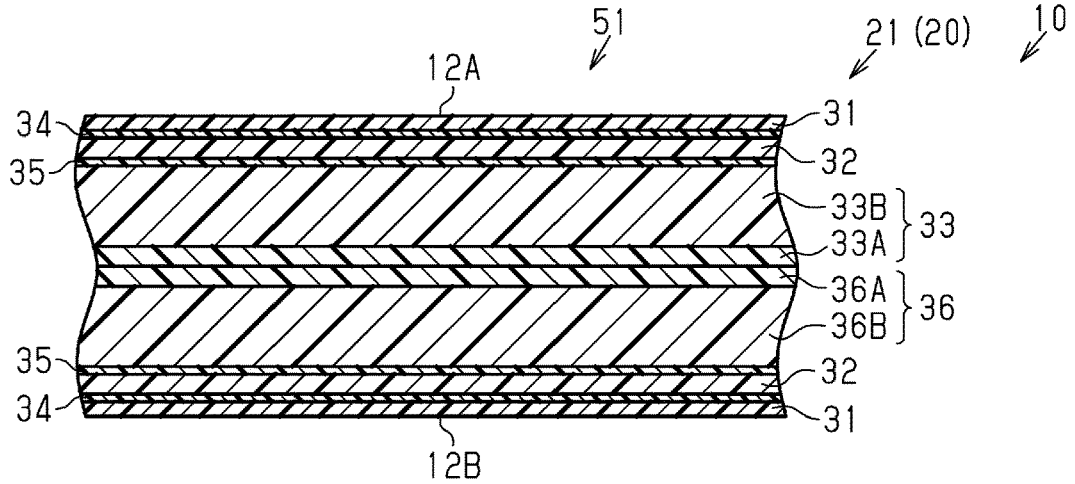
FIG. 4 is a cross-sectional view taken along line D4-D4 in FIG. 1.

The steam-releasing pouch 10 is divided into a pouch body 11 and a projection 12. The pouch body 11 includes the sealing portion 40 and the inner portion 23 and forms a main part of the accommodation compartment 10C. The projection 12 projects from the pouch body 11 and is formed by folding the first sheet 21 along a folding line 21B. A space 12C extends between a first portion 12A and a second portion 12B located on opposite sides of the folding line 21B of the first sheet 21 that forms the projection 12. The space 12C is connected to the accommodation compartment 10C. The projection 12 is located toward the upper sealing portion 41 of the steam-releasing pouch 10 in the standard height-wise direction. The sealant layer of the first portion 12A will be referred to as the first sealant layer 33 and the sealant layer of the second portion 12B will be referred to as a second sealant layer 36. The second sealant layer 36 includes a third base layer 36A and a fourth base layer 36B (refer to FIG. 4). The material of the third base layer 36A and the inner structure of the third base layer 36A are the same as the first base layer 33A. The material of the fourth base layer 36B and the inner structure of the fourth base layer 36B are the same as the second base layer 33B.

The width and the height of the pouch body 11 are preferably determined in accordance with the relationship between, for example, the quantity of accommodated content C and the easiness of transportation of the steam-releasing pouch 10. The width of the pouch body 11 is the length between the outer edge 43B of the first side sealing portion 43 and the outer edge 44B of the second side sealing portion 44 on a line segment orthogonal to the standard height-wise direction. If the width of the pouch body 11 differs between parts, the maximum width, for example, or an average width of several parts represents the width of the pouch body 11. In one example, the width of the pouch body 11 is 140 mm. The height of the pouch body 11 is the length between the outer edge 41B of the upper sealing portion 41 and the outer edge 42B of the lower sealing portion 42 on a line segment orthogonal to the standard widthwise direction. If the height of the pouch body 11 differs between parts, the maximum height, for example, or an average height of several portions represents the height of the steam-releasing pouch 10. In one example, the height of the pouch body 11 is 170 mm.

The opening 60 (refer to FIG. 3) is formed between a lower portion 21A of the first sheet 21 and a lower portion 22A of the second sheet 22 so that the content C can be arranged in the accommodation compartment 10C. In the steam-releasing pouch 10 shown in FIG. 1, the opening 60 is closed by the lower sealing portion 42. The steam-releasing pouch 10 in which the opening 60 is closed (hereafter "closed steam-releasing pouch 10") includes a body portion 10A and a separated portion 10B. The body portion 10A and the separated portion 10B are divided by a cutting line 71, which forms the guide portion 70. The body portion 10A accommodates the content C. The separated portion 10B is the part of the sheets 21, 22 including the upper sealing portion 41. When the user cuts out the separated portion 10B from the body portion 10A, an opening (not shown) through which the content C can be removed from the accommodation compartment 10C is formed between the first sheet 21 and the second sheet 22.

The guide portion 70 is formed between the body portion 10A and the separated portion 10B so that the sheets 21, 22 can be easily cut when separating the separated portion 10B from the body portion 10A. The guide portion 70 includes the cutting line 71 and a notch 72. The cutting line 71 is a line of perforations formed in the sealing portions 43, 44 and the inner portion 23 of the sheets 21, 22. The notch 72 is formed in at least one of the first side sealing portion 43 or the second side sealing portion 44 so that a distal end of the notch 72 is located on an imaginary line, which is an extension of the cutting line 71. FIG. 1 shows an example in which the notch 72 is formed in each of the first side sealing portion 43 and the second side sealing portion 44.

The steam-releasing pouch 10 is heated by a heating means (heating device) so that the content C is heated. One example of the heating means is a microwave oven. Steam is generated from the content C when the steam-releasing pouch 10 is heated. Since the accommodation compartment 10C of the closed steam-releasing pouch 10 is closed by the sealing portion 40, the generation of heat increases the pressure of the accommodation compartment 10C. The steam-releasing portion 50 is configured to open as the pressure of the accommodation compartment 10C increases and discharge steam from the accommodation compartment 10C out of the steam-releasing pouch 10. In a preferable example, the steam-releasing portion 50 is configured to open when the pressure in the accommodation compartment 10C rises to a predetermined value. The steam-releasing portion 50 can be arranged at any location. In a first example, the steam-releasing portion 50 is arranged in the projection 12. In a second example, the steam-releasing portion 50 is arranged in the first side sealing portion 43 or the second side sealing portion 44. In a third example, the steam-releasing portion 50 is arranged in the first side sealing portion 43 and the second side sealing portion 44. FIG. 1 shows the first example.

The steam-releasing portion 50 includes the steam-releasing sealing portion 51 and slits 52. The steam-releasing sealing portion 51 is where the first base layer 33A of the first sealant layer 33 and the third base layer 36A of the second sealant layer 36 are joined together (refer to FIG. 4). The steam-releasing sealing portion 51 includes a first sealing portion 51A, a second sealing portion 51B, a third sealing portion 51C, a fourth sealing portion 51D, a fifth sealing portion 51E, a sixth sealing portion 51F, and a seventh sealing portion 51G.

The first sealing portion 51A is arranged on one edge of the first portion 12A and one edge of the second portion 12B in the standard widthwise direction. The second sealing portion 51B is continuous with the first sealing portion 51A and extends in parallel with the folding line 21B. The third sealing portion 51C is continuous with the second sealing portion 51B and inclined toward the upper sealing portion 41 from the first side sealing portion 43 toward the second side sealing portion 44. The fourth sealing portion 51D is continuous with the third sealing portion 51C and is recessed from the upper side toward the lower side in the standard height-wise direction. The fourth sealing portion 51D is located where a strong stress concentrates when the pressure increases in the accommodation compartment 10C and the space 12C of the sheets 21, 22. The fifth sealing portion 51E is continuous with the fourth sealing portion 51D and inclined toward the lower sealing portion 42 from the first side sealing portion 43 toward the second side sealing portion 44. The sixth sealing portion 51F is continuous with the fifth sealing portion 51E and extends in parallel with the folding line 21B. The seventh sealing portion 51G is arranged on the other edge of the first portion 12A and the other edge of the second portion 12B in the standard widthwise direction.

The slits 52 are arranged between the folding line 21B and the steam-releasing sealing portion 51 of the projection 12. The slits 52 may take any of a variety of forms. In a first example, the slits 52 are holes that extend through at least one of the first portion 12A or the second portion 12B of the sheets 21, 22. In a second example, the slits 52 are holes that do not extend through at least one of the first portion 12A or the second portion 12B of the sheets 21, 22. Preferably, the depth of the slits 52 in the second example is set so that the parts including the slits 52 of the first portion 12A or the second portion 12B tear when the pressure in the accommodation compartment 10C and the space 12C increases and the steam-releasing sealing portion 51 opens.

Figure 3:
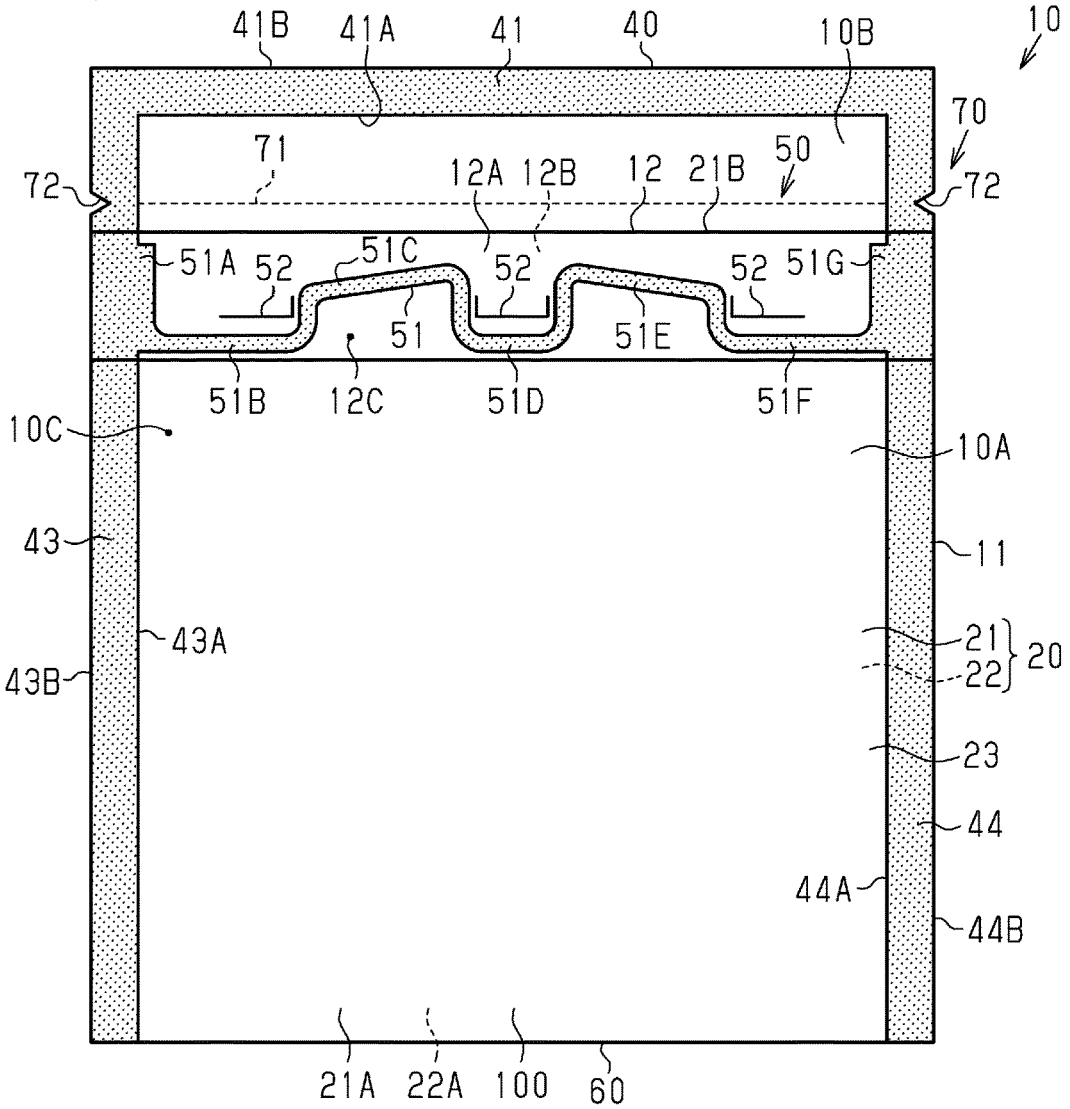
FIG. 3 is a front view of a steam-releasing pouch in FIG. 1 before an opening is closed.

FIG. 3 shows the steam-releasing pouch 10 before the opening 60 is closed (hereafter "steam-releasing pouch 10 prior to closing"). The content C (refer to FIG. 1) is arranged in the accommodation compartment 10C from the opening 60 of the steam-releasing pouch 10 prior to closing. After the arrangement of the content C, a sealed portion 100 where the lower sealing portion 42 is formed undergoes heat sealing to form the lower sealing portion 42 and obtain the closed steam-releasing pouch 10 shown in FIG. 1.

One example of how to use the steam-releasing pouch 10 will now be described.

Figure 5:
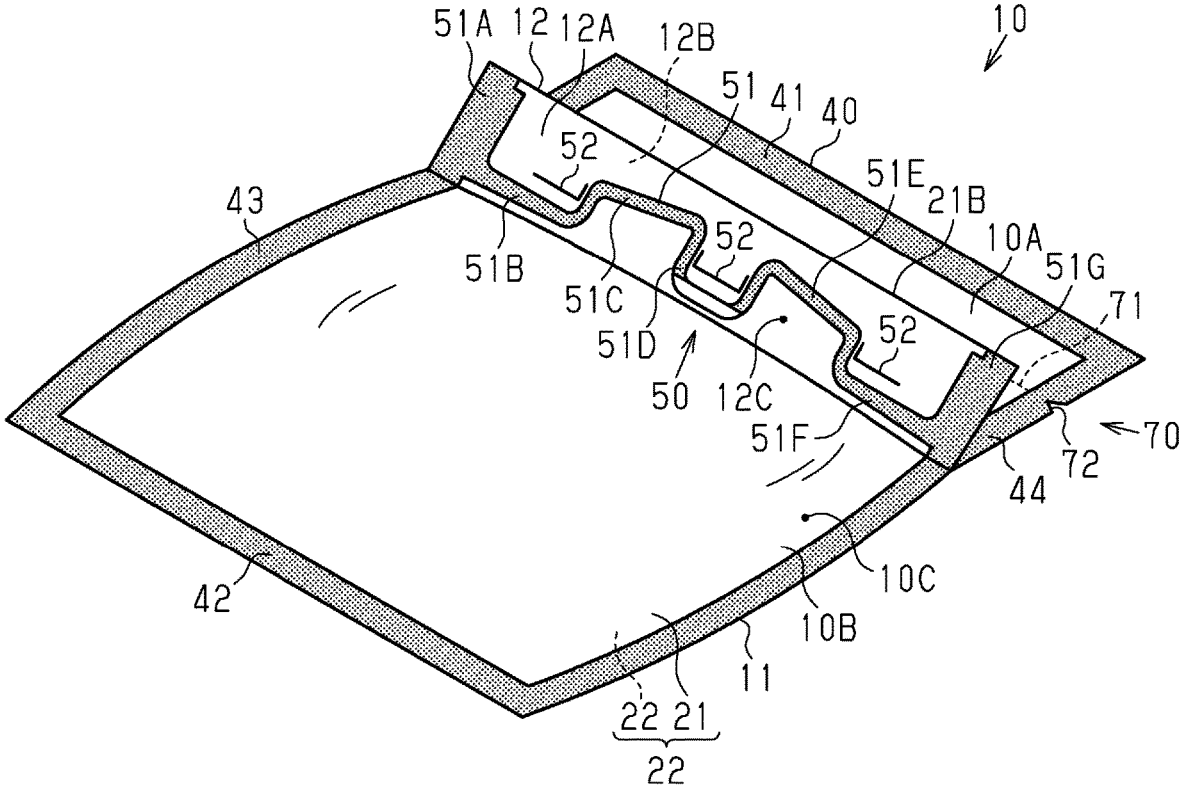
FIG. 5 is a perspective view of the steam-releasing pouch in FIG. 1 in a state in which part of a steam-releasing sealing portion is separated.

As shown in FIG. 5, in a state in which the projection 12 is directed upward, the closed steam-releasing pouch 10 is placed in a heating means such as a microwave oven (not shown) and heated by the heating means. When the heating is completed, a user rips the sheets 21, 22 from the distal end of the notch 72 and applies force to the sheets 21, 22 to continue ripping the sheets 21, 22 along the cutting line 71. When the separated portion 10B is separated from the body portion 10A, an opening is formed between the first sheet 21 and the second sheet 22 and the content C is removed from the steam-releasing pouch 10 through the opening.

The operation of the steam-releasing pouch 10 will now be described.

Figure 6:
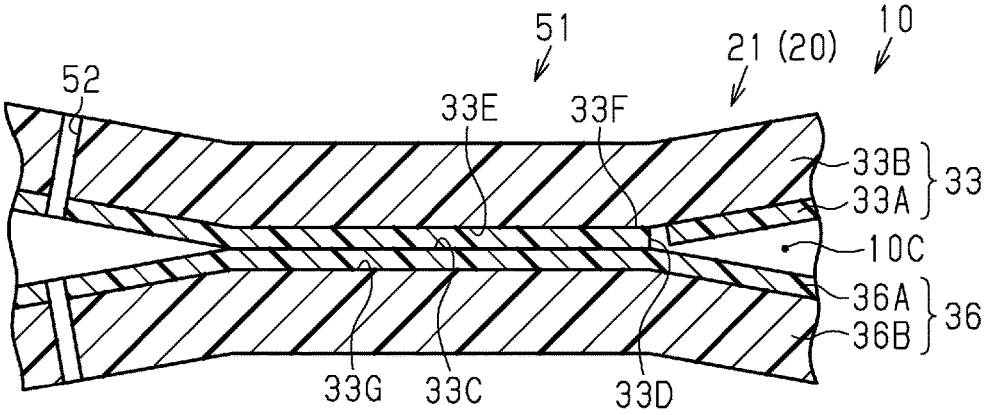
FIG. 6 is a cross-sectional view taken along line D6-D6 in FIG. 1.
Figure 7:
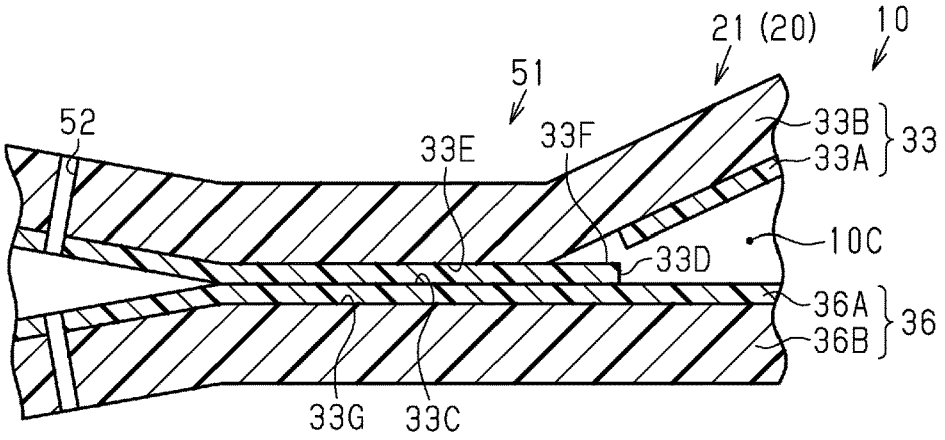
FIG. 7 is a cross-sectional view showing a state in which a first base layer in FIG. 6 is torn.

When the heating of the content C increases the pressure of the accommodation compartment 10C, force acts on the first base layer 33A and the third base layer 36A to separate the first base layer 33A and the third base layer 36A from each other at an edge 33D of an interface 33C of the first base layer 33A and the third base layer 36A in the steam-releasing sealing portion 51. If the direction in which separation advances in the steam-releasing sealing portion 51 is the same as the direction orthogonal to the machine direction of resin or substantially the same as the direction orthogonal to the machine direction of resin, stress concentrates on the edge 33D of the interface 33C of the first base layer 33A and the third base layer 36A and partially tears one or both of the first base layer 33A and the third base layer 36A. As shown in FIG. 6, if the first base layer 33A, for example, is torn, an edge 33F is formed at the torn part in an interface 33E of the first base layer 33A and the second base layer 33B of the first sealant layer 33. The edge 33F is exposed to the accommodation compartment 10C, and the pressure in the accommodation compartment 10C acts on the interface 33E of the first base layer 33A and the second base layer 33B and separates the first base layer 33A and the second base layer 33B from each other. The base layers 33A, 33B of the sealant layer 33 are joined together at the interface 33E in a separable manner by a relatively weak force. The base layers 36A, 36B of the sealant layer 36 are joined together at an interface 33G in a separable manner by a relatively weak force. Thus, when a force acts to separate the first base layer 33A and the second base layer 33B, the first base layer 33A and the second base layer 33B are cleanly separated as shown in FIG. 7. As the separation of the first base layer 33A and the second base layer 33B further advances, a first separation state or a second separation state will usually be obtained as described below.

Figure 8:
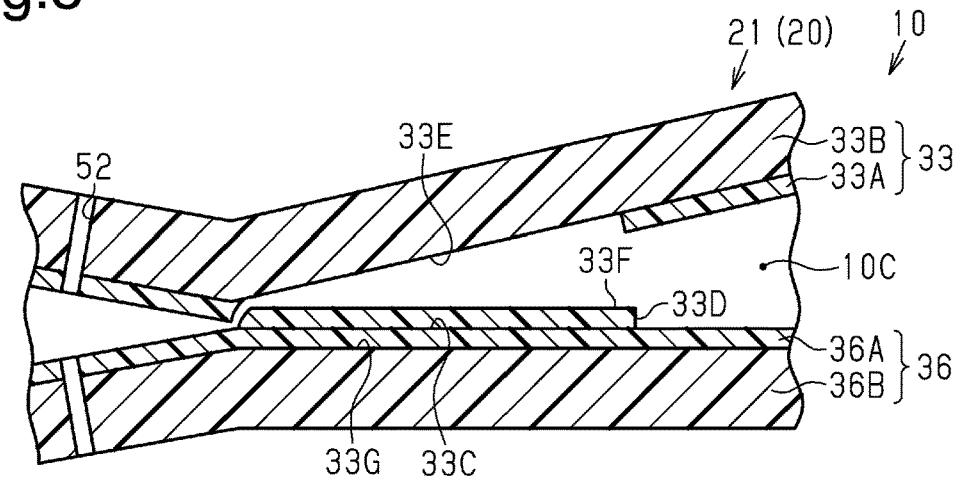
FIG. 8 is a cross-sectional view showing a first separation state of the steam-releasing sealing portion.
Figure 9:
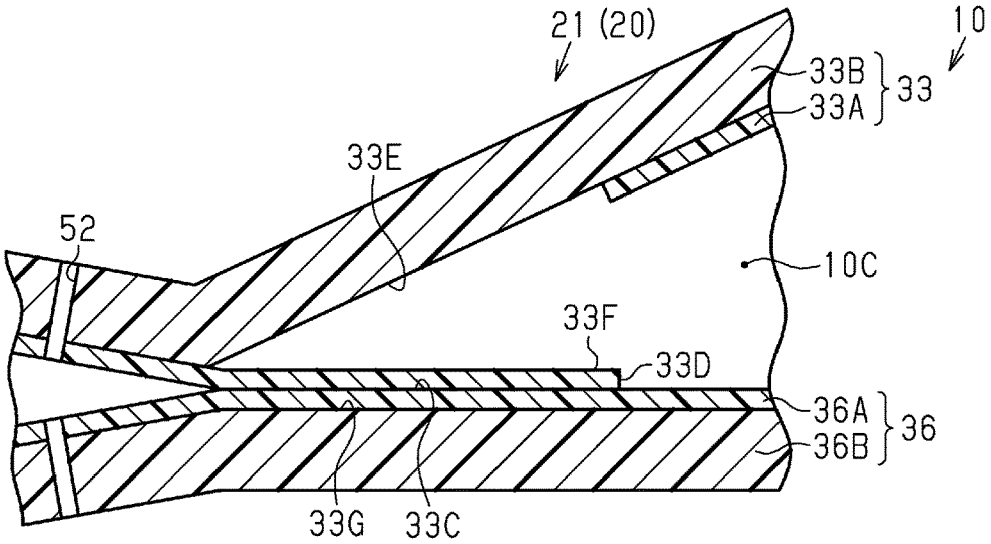
FIG. 9 is a cross-sectional view showing a second separation state of the steam-releasing sealing portion.

In the first separation state shown in FIG. 8, the first base layer 33A located toward an outer side of the steam-releasing pouch 10 from the interface 33C of the first base layer 33A and the second base layer 33B before separation is partially torn so that the accommodation compartment 10C is connected with the outside of the steam-releasing pouch 10. In the second separation state shown in FIG. 9, separation of the first base layer 33A and the second base layer 33B advances until the accommodation compartment 10C is connected with the outside of the steam-releasing pouch 10. In this manner, with the steam-releasing pouch 10, if the direction in which separation advances in the steam-releasing sealing portion 51 is the same as the direction orthogonal to the machine direction of resin or substantially the same as the direction orthogonal to the machine direction of resin, the separation advances in at least one of between the base layers 33A, 33B of the first sealant layer 33 or between the base layers 36A, 36B of the second sealant layer 36 instead of between the first sealant layer 33 and the second sealant layer 36. This results in appropriate separation in the steam-releasing sealing portion 51. Thus, steam will be easily discharged in an appropriate manner.

Examples

The inventor of the present disclosure used samples of examples and a comparative example to observe the relationship between the configuration of the first sheet 21 and the steam releasing properties of the steam-releasing pouch 10. FIG. 10 shows test conditions in the examples and the comparative example. FIG. 11 shows the result of the test. In the following description, for the sake of convenience, same reference numerals are given to corresponding parts in the sample of the comparative example and the sample of the example. The samples of the examples are the steam-releasing pouch 10 of the above embodiment. The sample of the comparative example is a steam-releasing pouch 10 having a configuration differing from the configuration of the steam-releasing pouch 10 of the example. The steam-releasing pouch 10 of the comparative example differs from the steam-releasing pouch 10 of the example in that the first sealant layer 33 is a single layer. Otherwise, the steam-releasing pouch 10 of the comparative example is the same as the steam-releasing pouch 10 of the examples Specific materials of the example and the comparative example are described below. The material of the outermost layer 31 of the sheets 21, 22 is polyethylene terephthalate. The thickness of the outermost layer 31 is 12 μm. The material of the intermediate layer 32 of the sheets 21, 22 is nylon. The thickness of the intermediate layer 32 is 15 μm. The material of the first sealant layer 33 of the sheets 21, 22 of the comparative example is non-stretched polypropylene. That is, the first sealant layer 33 of the comparative example is a single layer. The material of the first sealant layer 33 of the sheets 21, 22 of the example is the same as that used in the embodiment. The layer thickness T of the first sealant layer 33 is 60 μm. The width of the steam-releasing pouch 10 is 140 mm. The height of the steam-releasing pouch 10 is 170 mm.

To evaluate steam releasing properties, the closed steam-releasing pouch 10 was heated by the heating means, and the steam-releasing sealing portion 51 was visually observed to check whether separation occurred without the generation of a residual film or strings. A residual film indicates a state in which the steam-releasing sealing portion 51 is not open as to sufficiently discharge steam. The generation of strings indicates a state in which the steam-releasing sealing portion 51 is open to sufficiently discharge steam but some of the material of the first sealant layer 33 remains in the form of strings. The test was conducted ten times. The content C was water. The weight of the content was 50 g. The output of a microwave oven was 1000 W. The heating time of the microwave oven was one minute. In FIG. 11, "○" indicates a case in which the steam-releasing sealing portion 51 opened without generating a residual film or strings. In FIG. 11, "Δ" indicates a case in which the steam-releasing sealing portion 51 opened generating strings. In FIG. 11, "x" indicates a case in which the steam-releasing sealing portion 51 opened generating a residual film.

As shown in FIG. 11, according to the steam-releasing pouch 10 of the example, the steam-releasing sealing portion 51 opened and discharged steam appropriately without substantially generating a residual film or strings.

The invention claimed is:

1. A steam-releasing pouch comprising:

two laminated sheets forming an accommodation compartment that accommodates a content;

a sealing portion that seals the two laminated sheets to form an opening that opens part of the accommodation compartment; and a steam-releasing sealing portion formed in the sealing portion to open as pressure of the accommodation compartment increases in a state in which the opening is sealed, wherein the steam-releasing sealing portion includes a first sealant layer having at least a first base layer that faces the accommodation compartment and a second base layer laminated with the first base layer and a second sealant layer having at least a third base layer that faces the accommodation compartment and a fourth base layer laminated with the third base layer, the first base layer and the third base layer are joined together, the steam-releasing sealing portion is arranged in a projection, which is formed by folding one of the two laminated sheets, the projection includes a folding line that extends along a peak of the projection, the steam-releasing sealing portion includes a first sealing portion, a second sealing portion, a third sealing portion, a fourth sealing portion, a fifth sealing portion, a sixth sealing portion, and a seventh sealing portion, the first sealing portion is arranged on one edge of the steam-releasing pouch in a widthwise direction, and continuous with the folding line, the second sealing portion is continuous with the first sealing portion and the third sealing portion, and extends in parallel with the folding line, the third sealing portion is inclined toward the folding line from a one side toward the other side of the steam-releasing pouch in the widthwise direction, and not continuous with the folding line, the fourth sealing portion is continuous with the third sealing portion, recessed away from the folding line, and not continuous with the folding line, the fifth sealing portion is continuous with the fourth sealing portion, inclined away from the folding line from the one side toward the other side of the steam-releasing pouch in the widthwise direction, and not continuous with the folding line, the sixth sealing portion is continuous with the fifth sealing portion and the seventh sealing portion, and extends in parallel with the folding line, the seventh sealing portion is arranged on the other edge of the steam-releasing pouch in the widthwise direction, and continuous with the folding line, slits are arranged in corresponding positions along the second sealing portion and the sixth sealing portion, respectively, in the widthwise direction, the second sealing portion is recessed from the third sealing portion in a direction away from the folding line so as to accommodate a corresponding one of the slits, and the sixth sealing portion is recessed in the direction from the fifth sealing portion away from the folding line so as to accommodate a corresponding another one of the slits.

2. The steam-releasing pouch according to claim 1, wherein the first base layer and the second base layer have different inner structures, the third base layer and the fourth base layer have different inner structures, and the first base layer and the third abase layer have the same inner structure.

3. The steam-releasing pouch according to claim 1, wherein the first base layer, the second base layer, the third base layer, and the fourth base layer contain block copolymers, the block copolymer has a percentage of weight that differs between the first base layer and the second base layer, and the block copolymer has a percentage of weight that differs between the second base layer and the fourth base layer.

4. The steam-releasing pouch according to claim 1, wherein the second base layer has a thickness that is less than or equal to 95% of a thickness of the first sealant layer.

5. The steam-releasing pouch according to claim 4, wherein the second base layer has a thickness that is less than or equal to 92% of the thickness of the first sealant layer.

6. The steam-releasing pouch according to claim 1, wherein the second base layer has a thickness that is greater than or equal to 50% of a thickness of the first sealant layer.

7. The steam-releasing pouch according to claim 6, wherein the second base layer has a thickness that is greater than or equal to 58% of the thickness of the first sealant layer.

8. The steam-releasing pouch according to claim 1, wherein the first base layer has a thickness that is less than or equal to 50% of a thickness of the first sealant layer.

9. The steam-releasing pouch according to claim 8, wherein the first base layer has a thickness that is less than or equal to 42% of the thickness of the first sealant layer.

10. The steam-releasing pouch according to claim 1, wherein the first base layer has a thickness that is greater than or equal to 5% of a thickness of the first sealant layer.

11. The steam-releasing pouch according to claim 10, wherein the first base layer has a thickness that is greater than or equal to 8% of the thickness of the first sealant layer.

12. The steam-releasing pouch according to claim 1, wherein the first base layer has a thickness that is within a range of 5% to 100% in percentage relative to a thickness of the second base layer.

13. The steam-releasing pouch according to claim 12, wherein the first base layer has a thickness that is within a range of 9% to 71% in percentage relative to the thickness of the second base layer.

14. The steam-releasing pouch according to claim 1, wherein the two sheets include a pouch body that forms a main part of the accommodation compartment, wherein the projection is configured to pop out of the pouch body.

15. The steam-releasing pouch according to claim 1, further comprising another slit arranged in corresponding position in the fourth sealing portion in the widthwise direction, and all slits are aligned with each other in the widthwise direction.

16. The steam-releasing pouch according to claim 1, wherein the slits are holes that do not extend through one of the sheets in which the slits are formed.

* * * * *